United States Patent [19]

Roberts

[11] 4,011,879

[45] Mar. 15, 1977

[54] COMBINATION APPLICATOR-DISPENSER HAIR STYLER

[76] Inventor: Shepard D. Roberts, P.O. Box 136-Brevoort Station, Brooklyn, N.Y. 11216

[22] Filed: June 3, 1976

[21] Appl. No.: 692,319

[52] U.S. Cl. ..... 132/9; 132/42 R; 222/565; 132/88.5

[51] Int. Cl.[2] ..... A45D 2/12

[58] Field of Search ..... 132/9, 88.5, 88.7, 40, 132/42, 34; 222/478, 565; 15/140.3

[56] References Cited

UNITED STATES PATENTS

| | | | |
|---|---|---|---|
| 706,732 | 8/1902 | Ellington | 222/565 |
| 1,655,719 | 1/1928 | Wilkinson | 222/478 |
| 2,747,585 | 5/1956 | Allen, Jr. | 132/42 R |
| 3,376,875 | 4/1968 | Rosan | 132/34 |

*Primary Examiner*—G.E. McNeill
*Attorney, Agent, or Firm*—Robert E. Burns; Emmanuel J. Lobato; Bruce L. Adams

[57] ABSTRACT

A collapsible tube hair applicator-dispenser whose contents are a preparation applied to hair for treatment thereof. The tube has a removable tubular cover which is conical and has serrations or teeth axially thereon so that the cover can function as a comb for working in the hair treatment preparation. The cover has a plurality of openings axially disposed and circumferentially spaced from the comb thereon for applying the contents of the tube dispenser on hair for a particular treatment. The cover is hooded by a conical hood which is removable. The cover and hood form a hair curler. The cover when removed from the tube can function as a hair-roller on which hair can be rolled and the hood slipped on axially over the hair and cover as a clip or clamp.

8 Claims, 4 Drawing Figures

COMBINATION APPLICATOR-DISPENSER HAIR STYLER

BACKGROUND OF THE INVENTION

This invention relates generally to treatment of hair and more particularly to a new and improved applicator-dispenser.

Applicator-dispensers used for hair stimulants and hair growers and the like are known. For example, such a device is shown in U.S. Pat. No. 593,748. The device disclosed therein has a dispenser with an applicator top or cover used generally for treatment of hair. The contents thereof may be, for example, a hair stimulant or grower for growing hair.

Moreover, hair rollers of all types of constructions are known. These rollers are constructed separately from any dispensers and hair rolling is accomplished with these rollers and then generally a dispenser is used for dispensing on the rolled hair a hair treatment preparation.

SUMMARY OF THE INVENTION

It is an object of the present invention to provide a new and improved applicator-dispenser having a cover and hood thereon usable as a hair roller and clamp in the manner of hair curlers.

Another object is to provide a dispenser and styler for treatment of hair.

The applicator-dispenser according to the invention is a conventional tubular collapsible tube for containing therein a preparation usable for application to hair. A hair curler closes the container. The hair curler is made up of a removable tubular cover on the collapsible tube closed at one end and removably mounted on the tube. The cover has a plurality of axial openings for dispensing the contents or hair treatment preparation. An opposite side of the cover is provided with serrations or teeth for use as a comb for brushing the hair subsequent to application of the preparation for styling or whatever in order to work in the preparation.

The removable cover is conically shaped and has axial beads having the openings therein for dispensing of the contents of the collapsible tube. These beads and the serrations having rounded edges tend to grip the hair strands securely upon removal of the cover and use thereof as a hair-roller by twisting or wrapping hair around the comb and beaded sides.

The applicator-dispenser is provided with a removable hood over the cover which is placed axially over the cover when being used as a hair-roller to clamp or clip the hair onto the hair-roller cover. This outside hood or cover is likewise cone-shaped and holds the rolled hair tightly on the inner core or hair-roller for quick curling.

BRIEF DESCRIPTION OF THE DRAWINGS

The above and other objects of the dispenser-applicator according to the invention will be readily evident upon the study of the following specification, claims and accompanying drawings in which:

DESCRIPTION OF THE PREFERRED EMBODIMENTS

Figure 1:
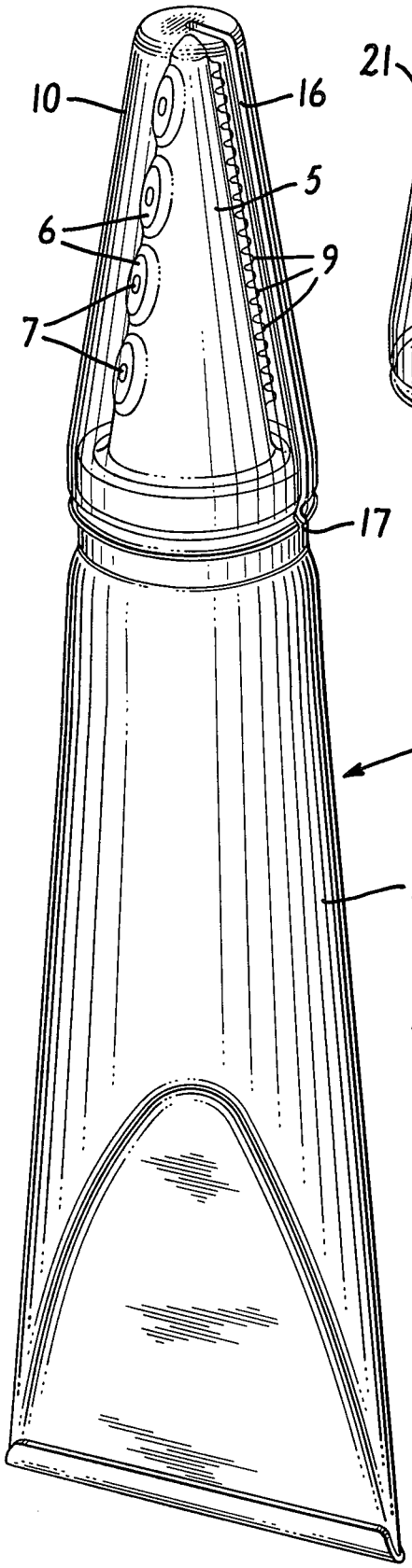
FIG. 1 is a side elevation view of an applicator-dispenser according to the invention.

An applicator-dispenser 1 according to the invention comprises a collapsible plastic tube 3 within which is contained a hair treatment preparation which may be a hair conditioner, pressing oil, pomade or hair straightener oil applied on hair strands when pressure is exerted on the tube. The tube is provided with a cover 5 having axially spaced on one side thereof beads 6 each having an opening 7 through which the contents of the dispenser tube are applied. The cover 5 is conically shaped so that the contents can be readily applied on hair through the openings 7.

Figure 2:
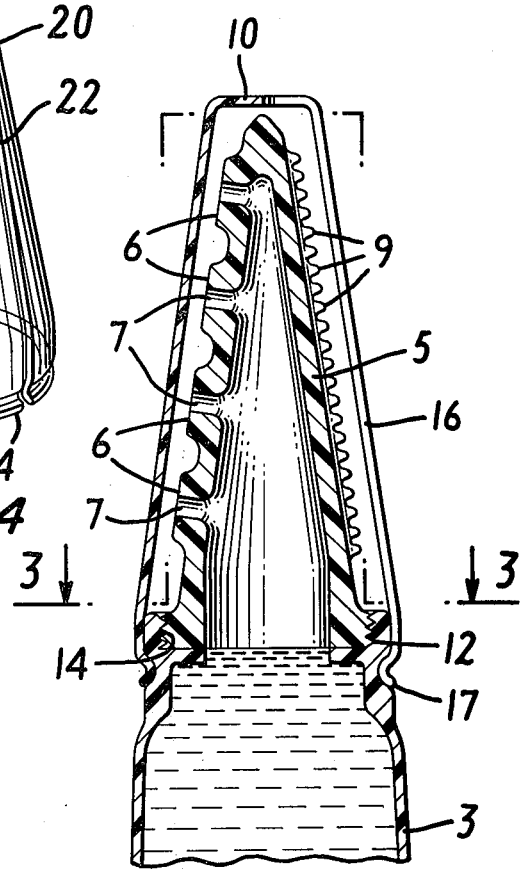
FIG. 2 is a fragmentary sectional view of a part of the applicator-dispenser in FIG. 1.
Figure 3:
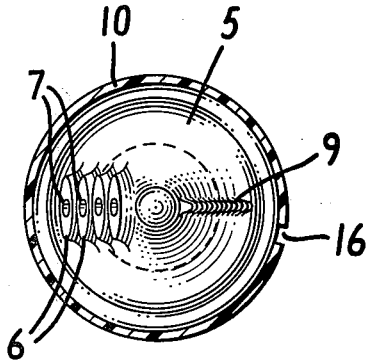
FIG. 3 is a section view taken along section line 3—3.

The dispenser cover is provided on the opposite sides of the beads with a serrated portion having serrations or teeth 9 that have rounded edges. This serrated portion forms a "comb" on the cover to more evenly spread or work in the preparation applied from the dispenser. The dispenser is provided with an outside cover or hood 10 which clips on the 3 as clearly shown in FIG. 2 and is likewise conical.

The applicator-dispenser is preferably contained in a container package, not shown, that will hold the tube 3 in a vertical position upon removal of the inside cover 5. The cover 5 is provided an external thread 12 threaded onto an internal thread 14 on the tube. The inside and ouside covers when removed are usable as a hair curler. The inner cover 5 once removed is tubular and can be used as a hair-roller on which hair is twisted or wrapped around for hair styling to assist in holding the hairs in position on the hair-roller. The outer cover 10 is placed axially over the hair-roller 5 to grip the hair strands securely in the manner of a clip or clamp.

In order to provide for easy fitting of the outside cover or hood 10 onto the hair-roller cover it is provided with an axial slit 16 extending from an open end 17 of the hood to the top thereof as illustrated in FIG. 1. The slit allows a radial or outward expansion of the hood as it is pressed on over the hair on the hair-roller 5 for quick development of curls and the like.

Figure 4:
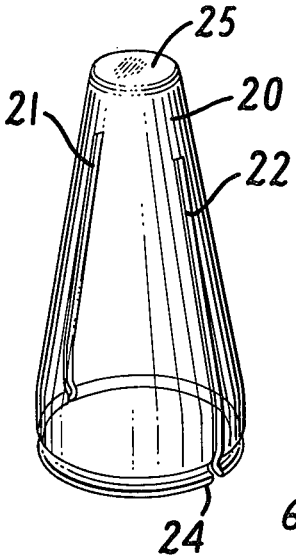
FIG. 4 is a side elevation view of a second embodiment of the hood or outside cover of the applicator-dispenser in FIG. 1.

A second type of hood is illustrated in FIG. 4 in which a hood 20 is provided with two axial slits 21, 22 that extend from an open end 24 of the hood 20 axially but terminate remote from a flat top 25 thereof. These two slits allow expansion outwardly of the hood when used as a clamp as part of a curler in the manner heretofore described.

After the contents of the tube have been expended the cover and hood are retained for use as a hair curler along with other similar hair curlers. Those skilled in the art will understand that the package may include hair curlers, made in a similar manner as an initial supply of curlers replaced or added to by other covers and hoods of applicator-dispensers bought and the contents thereof expended.

I claim:

1. A hair treatment applicator-dispenser comprising, a container for containing; therein a preparation usable for application to hair; a hair curler closing said container; said hair curler comprising a removable tubular cover on said container closed at one end and closing said container in use as a cover and usable as a hair curler having a length sufficient for wrapping hair therearound; said curler including a tubular hood removably mounted on said container axially over said cover; and said hood having one end closed and another open when removed from said container and a cross section dimensioned for fitting axially over said cover in use as a hair curler with hair wrapped therearound.

2. A hair treatment applicator-dispenser according to claim 1, in which said cover is substantially conical and said hood is conical.

3. A hair treatment applicator-dispenser according to claim 1, in which said cover has a row of serrations along an axial length thereof usable as a comb.

4. A hair treatment applicator-dispenser according to claim 1, in which said hood has an axial slit along a path of the axial length thereof, said slit terminating at said open end of the hood and remote from said closed end of said hood.

5. A hair treatment applicator-dispenser according to claim 4, in which said hood has a second axial slit similar to the first-mentioned slit spaced circumferentially from said first-mentioned slit.

6. A hair treatment applicator-dispenser according to claim 4, in which said hood has a second axial slit similar to the first-mentioned slit spaced circumferentially from said first-mentioned slit.

7. A hair treatment applicator-dispenser according to claim 1, in which said cover comprises a plurality of beads having rounded surfaces and spaced axially thereon; each bead having an opening therein.

8. A hair treatment applicator-dispenser according to claim 1, in which said tubular container comprises a collapsible tube.

* * * * *